US005215128A

United States Patent [19]

Neeser

[11] Patent Number: 5,215,128

[45] Date of Patent: Jun. 1, 1993

[54] SYRUP DELIVERY SYSTEM FOR CARBONATED BEVERAGES

[75] Inventor: Timothy A. Neeser, Burnsville, Minn.

[73] Assignee: Minnesota Valley Engineering, Inc., New Prague, Minn.

[21] Appl. No.: 711,085

[22] Filed: Jun. 6, 1991

[51] Int. Cl.[5] ..... B65B 31/00

[52] U.S. Cl. ..... 141/59; 141/104; 141/105; 141/91; 141/98; 137/113

[58] Field of Search ..... 141/2.31, 2, 9, 4, 5, 141/18, 59, 301, 302, 303, 307, 308, 198, 89, 91, 92, 98, 382, 199, 35, 325, 326, 383, 387, 327, 83, 90, 104, 105, 248; 261/DIG. 7

[56] References Cited

U.S. PATENT DOCUMENTS

| | | | |
|---|---|---|---|
| 3,008,482 | 11/1961 | Hunter | 137/113 |
| 3,592,215 | 7/1971 | Davis | 137/113 |
| 3,606,907 | 9/1971 | Stenberg | 137/113 |
| 4,247,018 | 1/1981 | Credle | 137/113 |
| 4,663,056 | 5/1987 | Leech | 137/192 |
| 4,683,921 | 8/1987 | Nesser | 141/1 |
| 4,763,683 | 8/1988 | Carmack | 141/346 |
| 5,011,700 | 4/1991 | Gustafson et al. | 426/477 |

OTHER PUBLICATIONS

Shurflo Brix Pump brochure.

*Primary Examiner*—Henry J. Recla
*Assistant Examiner*—David J. Walczak
*Attorney, Agent, or Firm*—Rockey, Rifkin and Ryther

[57] ABSTRACT

The delivery system of the invention overcomes the above-noted shortcomings and consists of at least two stainless steel, rigid syrup storage tanks. The tanks are connected to a carbonated beverage mixer and dispenser via a automatic vacuum selector valve. The valve operates to change over between tanks when the tank providing syrup becomes empty and a vacuum is created in the supply line to the selector valve. The vacuum is created in the supply line by an automatically operating valve that closes the supply line when the tank is empty. A cleaning system is also provided that can be connected to the vent of the empty tank to clean it before it is refilled with syrup. A drain line cooperates with the valve to maintain the valve in its open position and allow the cleaning fluid to drain from the tank.

31 Claims, 6 Drawing Sheets

SYRUP DELIVERY SYSTEM FOR CARBONATED BEVERAGES

BACKGROUND OF THE INVENTION

This invention relates, generally, to carbonated beverage delivery systems and, more particularly, to an automatic self-cleaning, two tank supply system for the beverage syrup.

As is well known in the art, a typical carbonated beverage system includes carbon dioxide, water and syrup stored in separate containers. These components are mixed together in the appropriate amounts to create the desired carbonated beverage. Such beverage systems are typically found in fast food restaurants and other similar establishments where carbonated beverages are sold in large quantities.

One such beverage system is disclosed in U.S. Pat. No. 4,683,921 issued to Neeser. This system includes two syrup storage tanks, means for filling the tanks and a sanitizing unit for cleaning the tanks and the means for filing the tanks. By using two storage tanks, syrup can be dispensed from one tank while the other tank is being cleaned and refilled such that the supply of syrup to the beverage dispenser is not interrupted.

While such a system provides for the continuous delivery of syrup, it requires the change over between the full tank and the empty tank to be accomplished manually. The manual change over is inefficient and unreliable as the syrup may unexpectedly run out before the change over occurs or the change over may be performed too soon thereby wasting the unused syrup.

Another type of syrup delivery system is the, so called, bag-in-box arrangement in which the rigid syrup storage tanks are replaced by plastic bags containing the syrup supported in cardboard boxes. The bags are connected to a vacuum selector valve that automatically changes over between the bags when the bags empty. The selector valve operates to change over between bags when it senses that a vacuum has been created by the empty bag. The selector valve is connected to a syrup pump, which is the driving force on the syrup.

While the bag-in-box system provides automatic change over, the delivery, storage and replacement of the bags and boxes is time consuming and inefficient. Moreover, because the bags and boxes are not reusable, their disposal creates environmental problems.

Thus a syrup delivery system that offers the convenience and ease of use of the permanent storage tanks and the automatic change over capability of the bag-in-box systems is desired.

SUMMARY OF THE INVENTION

The delivery system of the invention overcomes the above-noted shortcomings and consists of at least two stainless steel, rigid syrup storage tanks The tanks are connected to a carbonated beverage mixer and dispenser via an automatic vacuum selector valve and pump. The valve operates to change over between tanks when the tank providing syrup becomes empty and a vacuum is created in the supply line to the selector valve. The vacuum is created in the supply line by an automatically operating valve that closes the supply line when the tank is empty. A cleaning system is also provided to clean the empty tank before it is refilled with syrup. A drain line cooperates with the valve to maintain the valve in its open position and allow the cleaning fluid to drain from the tank.

DETAILED DESCRIPTION OF THE INVENTION

Figure 1:
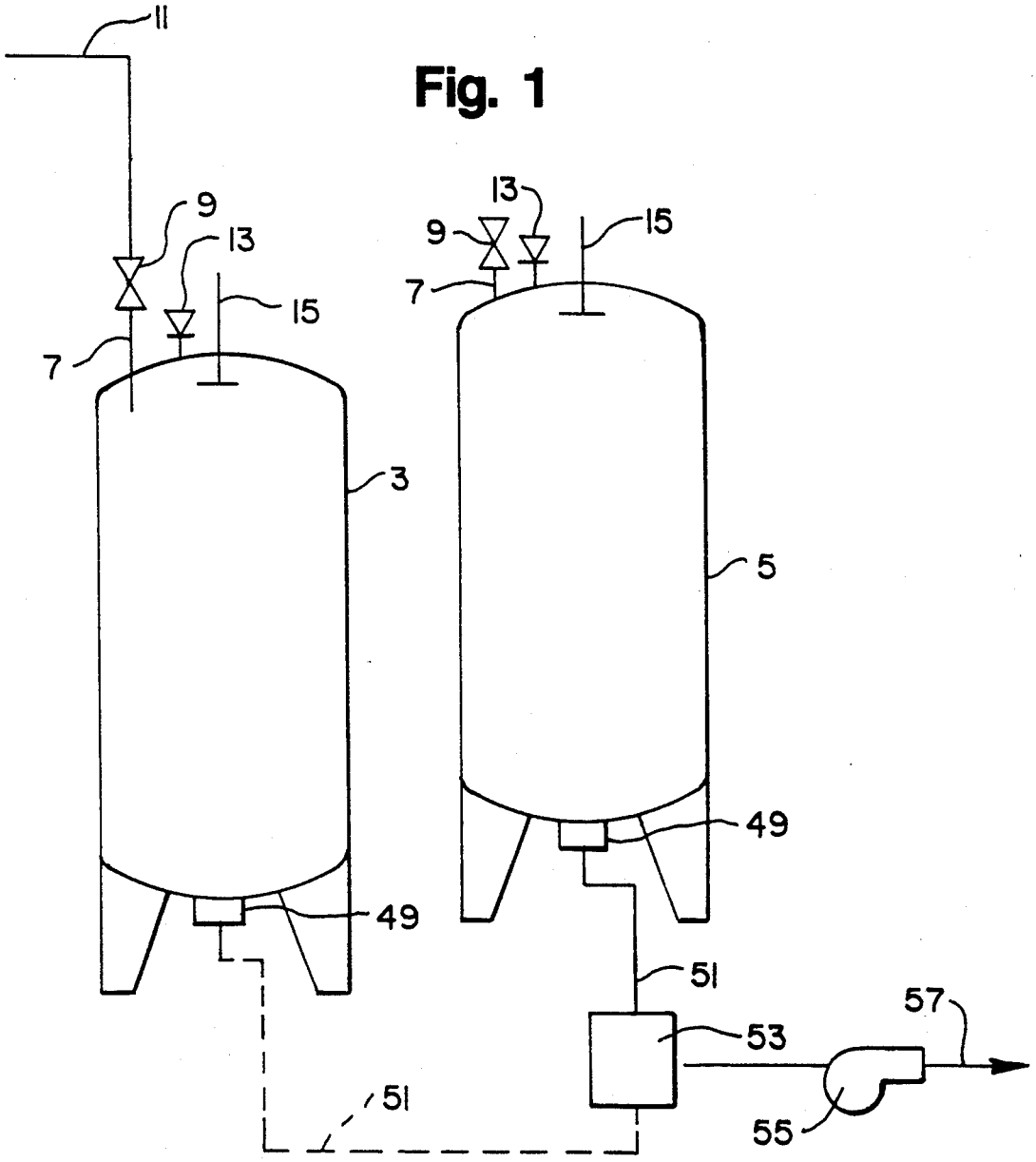
FIG. 1 is a schematic view of the delivery system of the invention in the supply and refill modes.

Referring more particularly to FIG. 1, the delivery system of the invention consists of at least two syrup storage tanks 3 and 5 having identical construction. Each tank includes a fill line 7 having a valve 9 thereon for connecting the fill line to a fill hose 11 from a mobile syrup supply such as a tank truck. Relief valves 13 are also provided in each of tanks 3 and 5 to vent fluid from the tanks if the pressure in the tanks should rise above a predetermined value.

Spray heads 15 are mounted in the tops of tanks 3 and 5 to vent gas from the tanks during the fill operation, to spray the cleaning solution into the tanks during the sanitizing operation and to vent gas into the tanks during the syrup supply operation.

Figure 2:
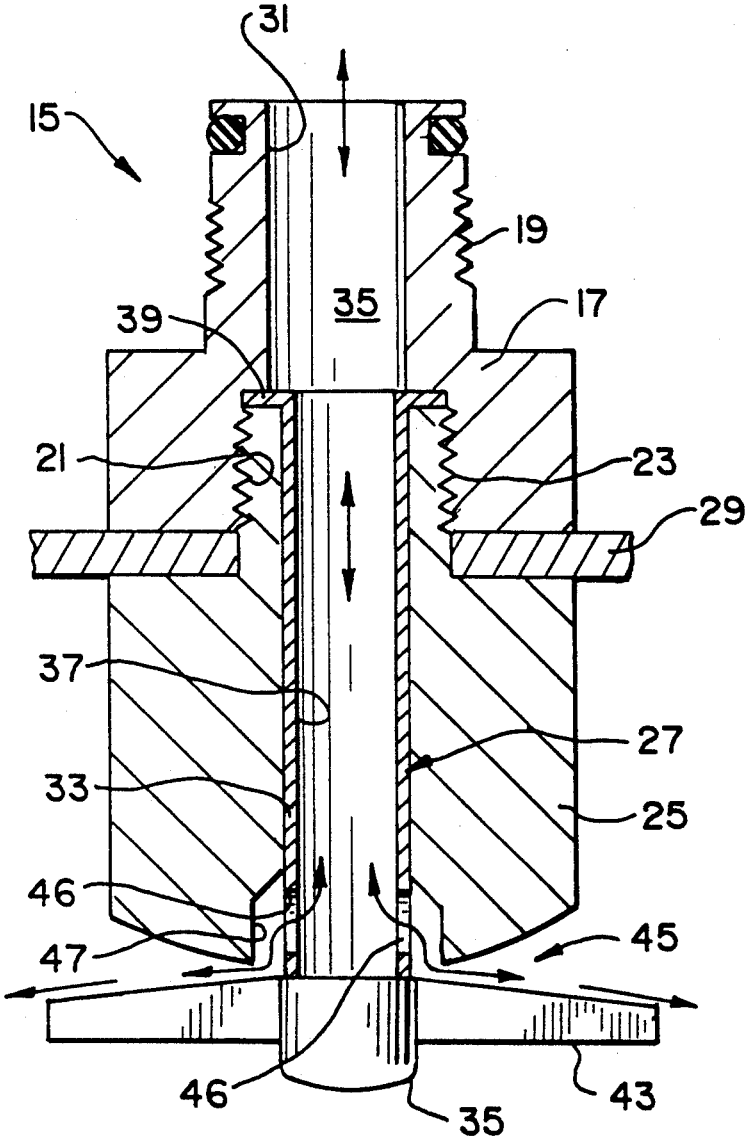
FIG. 2 is a section view of the spray head of the invention.

Referring more particularly to FIG. 2, spray head 15 consists of an upper portion 17 having a first set of screwthreads 19 formed thereon for engaging a sanitizing line, as will hereinafter be described, and a second set of screwthreads 21 for engaging a mating set of screwthreads 23 formed on the lower portion 25 of spray head 15 such that these members can be screwed together with the closure assembly 29 of the tanks 3 and 5 gripped therebetween. The upper portion 17 and lower portion 25 include through holes 31 and 33, respectively. The through holes 31 and 33 align with one another when spray head 15 is mounted on the tanks such that a passage 35 is created between the interior of the tanks and the atmosphere. A quick disconnect coupling (not shown) is secured to screwthreads 19 to allow the spray head to be easily connected to the cleaning system, vent line or filter, as will hereinafter be described.

Located within passage 35 is a spray valve 27 consisting of a hollow tube 37 having an annular flange 39 located in one end thereof Flange 39 is clamped between the upper portion 27 and lower portion 25 to secure spray valve 27 in the spray head. Seals are provided to create a fluid-tight seal between the components. A circular spray disk 43 is secured to tube 33 such that a small gap 45 exists between the spray disk 43 and lower portion 25. Moreover, a plurality of apertures 46 are formed adjacent the end of tube 37 and the through hole 33 of lower portion 25 includes an enlarged portion 47 in the area of apertures 46 such that fluid can travel between the interior and exterior of the tanks along the path shown by arrows in FIG. 2. Specifically, during the filling operation, displaced air can be vented from the interior of the tank to the exterior as the syrup fills the tank. Moreover, during the syrup delivery operation air can be vented into the interior of the tank. During the syrup delivery operation a filter (not shown) is connected to the spray head 15 to ensure that the air entering the tank is free from bacteria and the like. During the cleaning operation cleaning solution can be delivered to the interior of the tank along the same path.

The cleaning system of the invention will now be described in detail with particular reference to FIG. 3. A supply of cleaning solution 50 such as a chlorine/water mixture is provided. A cleaning solution supply line 52 with injector 54 connects the sink pack 50 with a water supply line 56 which supplies water from a supply of water 58 under pressure. An electronically operated solenoid valve 60 is provided to control the supply of water. Supply line 56 splits into a first line 62 connected to spray head 15 and a second line 64 connected to fill line 7. A restrictor valve 66 is formed in line 64 such that 80% of the flow of cleaning solution travels through line 62. Finally, a supply of pressurized $CO_2$ 68 is connected to line 64 via line 70. An electronically controlled solenoid valve 72 is located in line 70 to control the flow of $CO_2$ to the tank. A timer controls the opening and closing of valves 60 and 72 as will be described.

In operation, lines 62 and 64 are connected to the spray head 15 and fill line 7, respectively, of an empty tank. The timer is initiated to control the opening and closing of valves 60 and 72. When the timer is started, valve 60 is opened for a predetermined length of time, for example 4 minutes. Water is delivered from supply 58, is mixed with cleaning solution at injector 54 and is delivered to the tank. At the end of four minutes, valve 60 is closed and valve 72 is opened for a predetermined length of time, for example 30 seconds. When valve 72 is opened, $CO_2$ under pressure is forced through fill pipe 7 and into the tank to flush the system. In a preferred embodiment the timer is set to run through the washing and flushing cycle twice. During the cleaning operation a drain line 48 is connected to the tank as will hereinafter be described.

Figure 3:
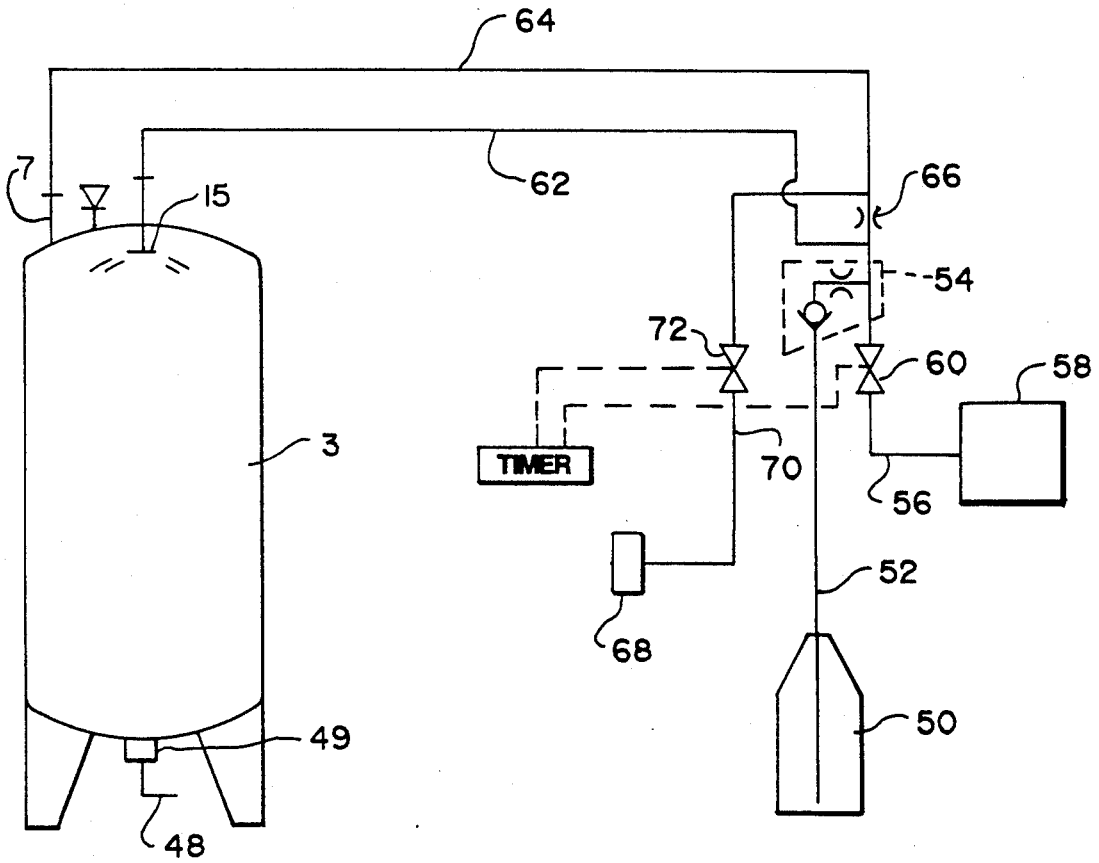
FIG. 3 is a schematic views of one the tanks of the system in the cleaning mode.

Valves 49 are provided in the bottom of tanks 3 and 5 and can be connected to either drain line 48 during the cleaning operation or supply lines 51 during the syrup supply operation as shown in FIG. 1 and 3. Referring more particularly to FIG. 1, supply lines 51 are connected to a selector valve 53 such as the type manufactured by SHURflo. Selector valve 53 selects between the supply line of tank 5 or tank 3 to provide a continuous supply of syrup to main supply line 55. Valve 53 changes over between tanks when valves 49 create a vacuum in their respective supply lines as will be hereinafter described. The main supply line 55 includes a pump 57 for delivering the syrup to the carbonated beverage mixer and dispenser as will be understood by one skilled in the art.

Figure 4:
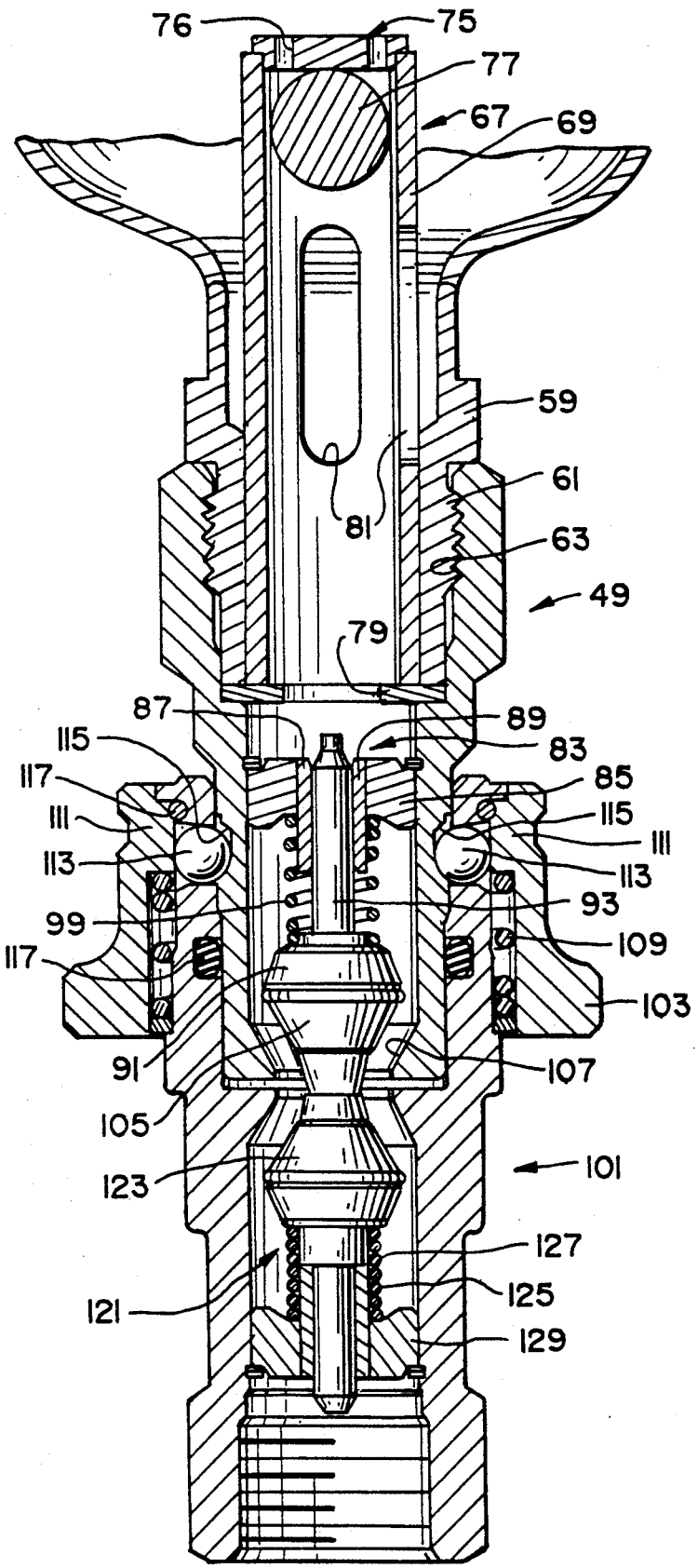
FIG. 4 is a section view of the valve of the invention during the filling and supply operations.
Figure 5:
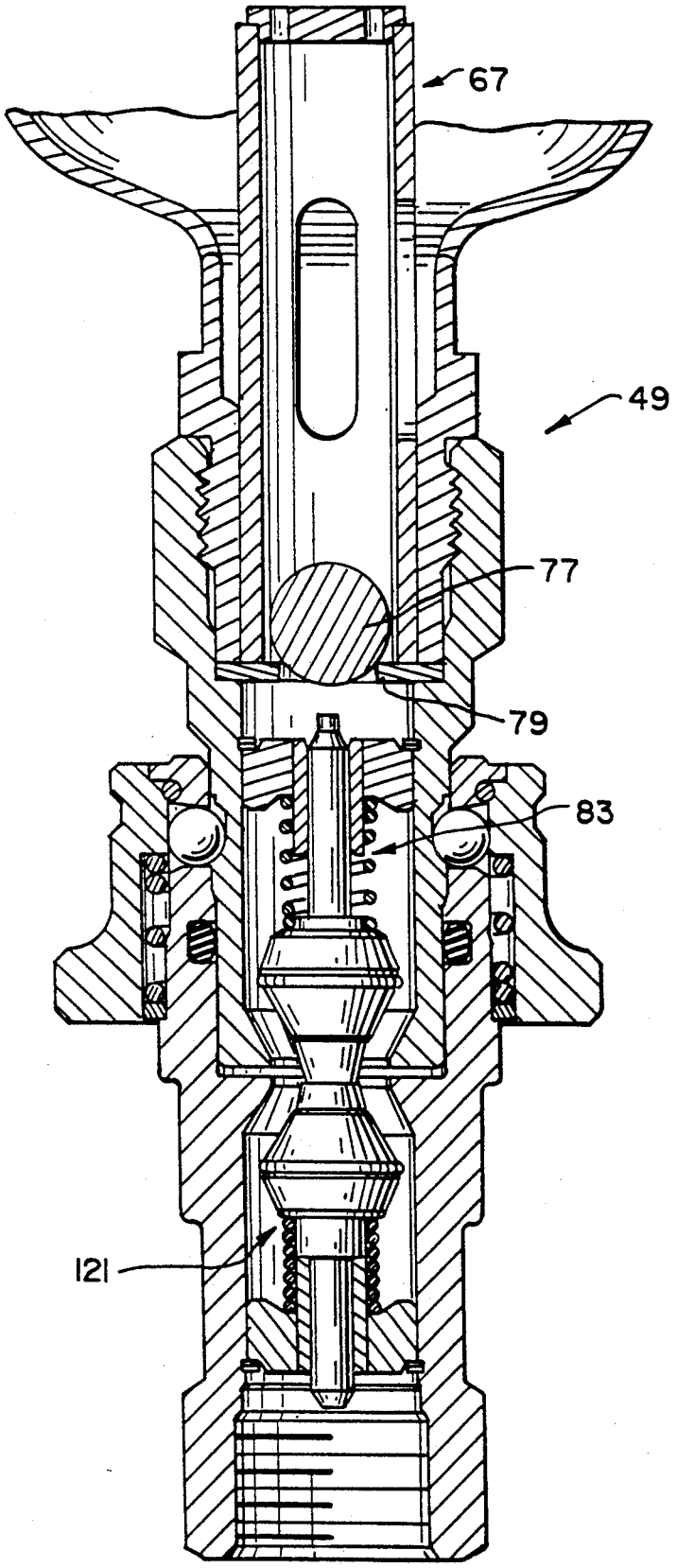
FIG. 5 is a section view of the valve of the invention when the tank is empty.
Figure 6:
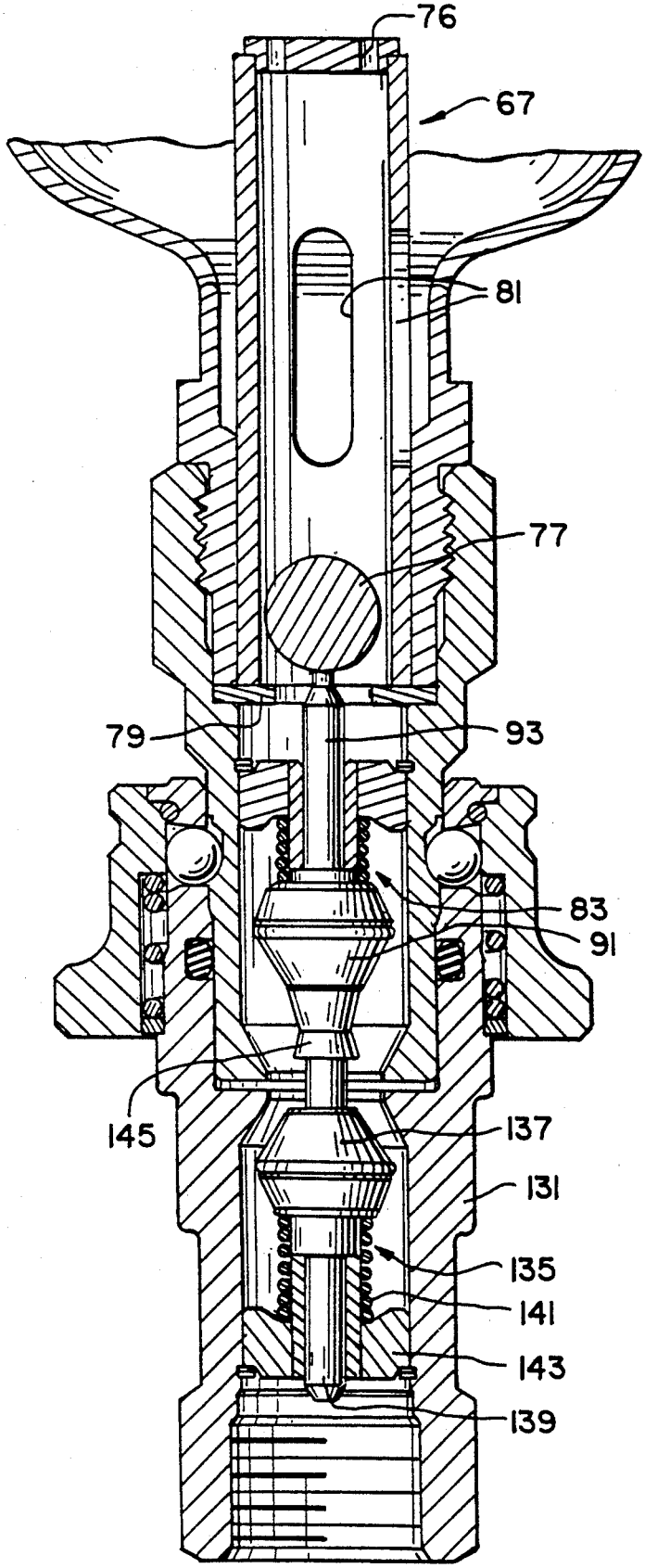
FIG. 6 is a section view of the valve of the invention during the cleaning operation.

Referring more particularly to FIG. 4, 5 and 6, valves 49 consist of a generally annularly shaped sleeve 59 fixed to the bottom of the tank so as to create an opening therein. Sleeve 59 includes screwthreads 61 formed thereon engaging mating screwthreads 63 formed on sleeve 65.

A vacuum valve 67 consisting of a tubular member 69 is mounted in sleeve 59. A suitable seal and seat 79 is provided to create a fluid tight seal between these members. A cap 75 closes off the top end of pipe 69. Cap 75 includes apertures 76 for allowing trapped air to flow out of member 69. A floating ball 77 is retained in pipe 69 and can freely reciprocate therein between cap 75 and valve seal and set 79. Valve seal and seat 79 is configured such that when ball 77 is seated thereon, as best shown in FIG. 5, the flow of fluid between the interior of the tank and sleeve 65 is prevented. Finally, tube 69 includes a plurality of elongated apertures 81 to allow the flow of syrup through member 69 when ball 77 is floating on the syrup as best shown in FIG. 4.

Mounted in lower sleeve 65 is a poppet assembly 83 consisting of a guide member 85 fixed to sleeve 65 and having an aperture 87 formed therein. Member 85 includes suitable openings to allow syrup to flow therethrough. A bushing 89 is fit into aperture 87 for receiving the stem 93 of poppet assembly 83. Stem 93 is connected to a valve body 91 having a seal 105. A compression spring 99 biases poppet away from guide 85 such that if hose connector assembly 101 was not mounted to sleeve 65, spring 99 would force poppet valve 91 against valve seat 107 formed on sleeve 65 to ensure a fluid tight seal with sleeve 65. Thus, if neither drain line or the supply line is connected to sleeve 65 poppet valve 91 seals the tank to prevent the escape of syrup therefrom.

FIGS. 4 and 5 show sleeve 65 connected to the connector 101 for supply lines 51. Connector 101 includes a locking sleeve 103 mounted for reciprocating movement over sleeve 101. A compression spring 109 biases sleeve 103 to the position shown in FIG. 4 such that fingers 111 contact balls 113 to force the ball into engagement with indents 115 formed on sleeve 65. To couple or uncouple connector 101 sleeve 103 is retracted such that balls 113 can disengage from indents 115 to thereby unlock the connector. A suitable seal 117 is provided to create a fluid tight seal between the components.

Connector 101 includes a poppet assembly 121 having a structure similar to that of poppet assembly 83 and includes poppet valve 123, stem 125, compression spring 127, and guide 129. When connector 101 is mounted on sleeve 65, poppet valve 91 engages poppet valve 123 as shown in FIG. 4. The springs 127 and 99 are designed such that neither poppet valve engages the associated valve seat and an open passage is created from the tank to line 51. It should be noted that stem 93 of poppet assembly 83 will not contact ball 77 in this position such that ball 77 is able to seat against valve seat 79 when the tank is empty, best shown in FIG. 5.

The connection between drain line 48 and sleeve 65 is best shown in FIG. 6. Connector 131 is connected to drain line 48 and includes a locking sleeve 103 for locking connector 131 to sleeve 65 in the same manner as has previously been described with reference to locking sleeve 103. Connector 131 includes a poppet assembly 135 having a structure substantially similar to that of poppet assembly 83 and includes poppet valve 137, stem 139, compression spring 141 and guide 143. Significantly, poppet assembly 135 also includes a stem 145 fixed to poppet valve 137 and extending into sleeve 65. Stem 145 engages poppet valve 91 and maintains it in a higher position relative to sleeve 65 than was the case with connector 101 as will be evident by comparing the position of valve body 91 in FIG. 4 with the position of valve body 91 in FIG. 6. As a result, stem 93 extends into tube 69 to engage ball 77 and prevent it from seating on valve seat 79. Thus, when line 48 is connected to valve 49 the inside of tank will always communicate with drain line 48.

The operation of valve 49 will be described with specific reference to FIGS. 1, 4, 5 and 6. When the tank is filled with syrup and valve 49 is connected to line 51, valve 49 will assume the position shown in FIG. 4 with the ball 77 abutting cap 77 as it floats in the syrup. As the level of syrup in the tank drops below the top of tube 69, ball 77 will drop along with the level of syrup until ball 77 seats in valve seat 79 when the tank is empty, as best shown in FIG. 5. When the ball is seated as shown in FIG. 5, a vacuum will be created in the delivery line 51 associated with that tank. The vacuum will cause selector valve 53 to changeover from the empty tank to the full tank as will be understood by one skilled in the art. When the empty tank is refilled, ball 77 will rise to the position shown in FIG. 4 to await a changeover from valve 53.

When the tank is connected to the drain line 48 for the cleaning operation, valve 49 will assume the position shown in FIG. 6 as previously described. Thus the cleaning fluid will be completely drained from the tank because the ball 77 is prevented from seating.

The operation of the system will now be described, it being assumed that both tanks 5 and 7 are filled with syrup and are connected to valve 53 via lines 51. Both tanks 5 and 3 have filters connected to valve 15. Valve 49 in both tanks 5 and 3 will assume the position shown in FIG. 4. One of the tanks, for example tank 3, will be initially selected to deliver syrup to the dispenser. As the carbonated beverage mixer and dispenser requires syrup, pump 57 will be activated such that the supply of syrup in tank 3 will gradually diminish. This process will continue until tank 3 is empty at which time valve 49 will assume the position shown in FIG. 5 such that a vacuum in line 51 is created. When valve 53 senses the vacuum in line 51, it will change over so as to supply syrup from tank 5.

As tank 5 delivers syrup, empty tank 3 will be connected to the cleaning system as shown in FIG. 2 with valve 49 connected to drain line 48 and fill line 7 and spray head 15 connected to the cleaning solution delivering lines 62 and 64, respectively, as shown in FIG. 3. The timer will be activated such that tank 3 will be cleaned as has been previously described. Once cleaned, tank 3 will be refilled via fill line 11 and will be reconnected to delivery line 51. Tank 3 will remain in this condition until tank 5 is empty and valve 53 changes over to supply syrup from tank 3. Tank 5 will be then cleaned and refilled. This process will be continuously repeated to provide an uninterrupted supply of syrup to the carbonated beverage mixer while allowing the supply tanks to be sanitized.

While the invention has been described in some detail, it is to be understood that applicant's invention is to be limited only by the appended claims.

What is claimed is:

1. A system for delivering syrup to a carbonated drink mixer, comprising:

a) a plurality of rigid storage tanks;

b) means for delivering syrup from one of said plurality of storage tanks to the carbonated drink mixer including a supply line communicating with each of said plurality of storage tanks said means for delivering being able to changeover from an empty storage tank to a full storage tank in response to a vacuum being created in the supply line communicating with said empty storage tank;

c) means for creating a vacuum in the supply lines; and d) means for cleaning the empty storage tank while the means for delivering continues to deliver syrup from another tank.

2. The delivery system according to claim 1, wherein said means for creating a vacuum consists of a passage formed in the storage tank connecting the interior of the tank with the means for delivering syrup, and a means for closing said passage when the tank is empty.

3. The delivery system according to claim 2, further including a cleaning means for cleaning the empty tank, said cleaning means including means for injecting a cleaning solution into the tank, said passage being connected to a drain line, said drain line including means for opening said means for closing said passage to allow said cleaning solution to drain from the tank.

4. The delivery system according to claim 2, said means for creating a vacuum further includes a floating ball that engages a valve seat to close the passage when the tank is empty.

5. The delivery system according to claim 1, wherein said means for delivering syrup consists of a vacuum actuated selector valve and a line connecting each of said plurality of tanks to said selector valve.

6. A system for delivering syrup to a carbonated beverage mixing apparatus, comprising:

a) at least two rigid storage tanks, each tank having a fill means, vent means and valve means for delivering fluid from said tank;

b) means for delivering syrup from one of the tanks to the mixing apparatus and for automatically changing over from an empty tank to a rigid tank in response to a vacuum being created at said value means.

7. The delivery system according to claim 6, including a means for cleaning said empty tank which includes means for delivering cleaning solution to said empty tank via said venting means.

8. The delivery system according to claim 7, said means for cleaning the empty tank further including means for automatically controlling the delivery of cleaning solution.

9. The delivery system according to claim 7, wherein said means for cleaning the empty tank further includes means for delivery cleaning solution to said fill means.

10. The delivery system according to claim 7, said means for cleaning the empty tank includes means for delivery $CO_2$ to the tank via said fill means.

11. The delivery system according to claim 6, further including means for creating a vacuum in said valve means.

12. The delivery system according to claim 11, wherein said means for creating a vacuum consists of a passage formed in the storage tank connecting the interior of the tank with the means for delivering syrup and a means for closing said passage when the tank is empty.

13. The delivery system according to claim 12, said means for creating a vacuum further includes a floating ball that engages a valve seat to close the passage when the tank is empty.

14. The delivery system according to claim 12, said passage further including a valve means for closing said passage when the means for delivering syrup is disconnected therefrom regardless of whether the tank is empty or full.

15. A system for continuous delivery of syrup, comprising:

(a) at least two syrup storage tanks, each of said tanks having associated therewith:

(i) a supply line to permit withdrawing syrup from the tank; and (ii) means for creating a vacuum in the supply line when said tank is substantially empty;

(b) means for withdrawing syrup from the tanks via said supply line;

(c) means responsive to said created vacuum for switching said syrup withdrawal means from the supply line associated with the substantially empty tank to another of said tanks; and (d) means for cleaning an empty syrup tank while the means for withdrawing continues to deliver syrup from another tank.

16. The delivery system according to claim 15, wherein said means for creating a vacuum consists of: (i) a passage formed in each tank for connecting the interior of the tank with the supply line, and (ii) means for closing said passage when the tank is substantially empty.

17. The delivery system according to claim 16, wherein said means for closing includes a floating ball that engages a valve seat.

18. The delivery system according to claim 15, wherein said means for cleaning includes means for sequentially injecting (i) cleaning solution into a tank to clean it, and (ii) $CO_2$ into the tank to purge the cleaning solution therefrom.

19. A system for delivering syrup to a carbonated drink mixer, comprising:

(a) a plurality of storage tanks;

(b) means for delivering syrup from one of said plurality of storage tanks to the carbonated drink mixer including a supply line communicating with each of said plurality of storage tanks, said means for delivering being able to change over from an empty storage tank to a full storage tank in response to a vacuum being created in the supply line communicating with the empty storage tank; and (c) means for creating a vacuum in the supply line consisting of a passage formed in the storage tank connecting the interior of the tank to the supply line and a floating element responsive to syrup level therein that engages a valve seat in said passage to close the passage when the tank is empty.

20. The delivery system according to claim 19, further including means for cleaning the empty storage tank while the means for delivering continues to deliver syrup from another tank.

21. The delivery system according to claim 1 or 20, wherein said means for cleaning includes means for injecting cleaning solution into the tank, means for injecting $CO_2$ into the tank and means for automatically controlling the means for injecting cleaning solution and means for injecting $CO_2$.

22. The delivery system according to claim 1 or 20, wherein said means for cleaning includes a passage formed in said tank connecting the interior of the tank to a drain line, said passage allowing a cleaning solution to drain from the tank.

23. The delivery system according to claim 2 or 19, wherein said passage further including a valve means for closing said passage when the means for delivering syrup is disconnected therefrom regardless of whether the tank is empty or full.

24. The delivery system according to claim 23, wherein said means for delivering syrup including a connector engageable with said passage and including means for opening said valve means when engaged.

25. The delivery system according to claim 24, wherein said means for opening said valve means consists of a poppet valve.

26. The delivery system according to claim 23, wherein said valve means consists of a poppet valve.

27. A system for continuous delivery of syrup, comprising:

(a) at least two syrup storage tanks, each of said tanks having associated therewith:

(i) a supply line to permit withdrawing syrup from the tank; and (ii) means for creating a vacuum in the supply line when said tank is substantially empty consisting of a passage formed in the tank for connecting the interior of the tank with the supply line and a floating member responsive to the syrup level therein that engages a valve seat in said passage for closing the passage when the tank is substantially empty;

(b) means for withdrawing syrup from one of the tanks via one of said supply lines: and (c) means responsive to said created vacuum for switching said syrup withdrawal means from the supply line associated with the substantially empty tank to another of said tanks.

28. The delivery system according to claim 27, further including means for cleaning an empty syrup tank while the means for withdrawing continues to deliver syrup from another tank.

29. The delivery system according to claim 16 or 27, said passage further including a valve means for closing said passage when the supply line is disconnected therefrom regardless of whether the tank is empty.

30. The delivery system according to claim 29, wherein said supply line includes a connector engageable with said passage and means for opening said valve means when said connector is engaged.

31. The delivery system according to claim 16 or 27, wherein said means for switching consists of a vacuum actuated selector valve, said supply lines connecting each of said syrup storage tanks to said selector valve.

* * * * *